US006454266B1

(12) United States Patent
Breeding et al.

(10) Patent No.: US 6,454,266 B1
(45) **Date of Patent: *Sep. 24, 2002**

(54) BET WITHDRAWAL CASINO GAME WITH WILD SYMBOL

(75) Inventors: John G. Breeding, Sedona, AZ (US); Mark L. Yoseloff; Russell B. Dunn, both of Henderson, NV (US)

(73) Assignee: Shuffle Master, Inc., Eden Prairie, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/928,645

(22) Filed: Aug. 13, 2001

Related U.S. Application Data

(63) Continuation-in-part of application No. 09/317,705, filed on May 24, 1999, now Pat. No. 6,273,424, which is a continuation-in-part of application No. 08/970,966, filed on Nov. 14, 1997, now Pat. No. 6,019,374, which is a continuation-in-part of application No. 08/198,368, filed on Feb. 18, 1994, now Pat. No. 5,437,462, which is a continuation of application No. 08/023,196, filed on Feb. 5, 1993, now Pat. No. 5,288,081.

(51) Int. Cl.[7] ..... A63F 1/00

(52) U.S. Cl. ..... 273/292; 273/274; 273/309; 273/236; 273/138.2; 463/20; 463/26

(58) Field of Search ..... 273/292, 274, 273/309, 236, 138.2; 463/20, 26

(56) References Cited

U.S. PATENT DOCUMENTS

| | | | | |
|---|---|---|---|---|
| 3,876,208 | A | 4/1975 | Wächtler et al. | 273/138 |
| 3,939,953 | A | 2/1976 | Miyazawa | 194/100 |
| 4,305,586 | A | 12/1981 | Richards | 273/274 |
| 4,593,904 | A | 6/1986 | Graves | 273/1 |
| 4,651,997 | A | 3/1987 | Wood | 273/274 |
| 4,652,998 | A | 3/1987 | Koza et al. | 364/412 |
| 4,659,087 | A | 4/1987 | Shen et al. | 273/274 |
| 4,743,022 | A | 5/1988 | Wood | 273/85 |
| 4,756,531 | A | 7/1988 | DiRe et al. | 273/138 |
| 4,813,675 | A | 3/1989 | Greenwood | 273/138 |
| 4,836,546 | A | 6/1989 | DiRe et al. | 273/138 |

(List continued on next page.)

FOREIGN PATENT DOCUMENTS

| | | | |
|---|---|---|---|
| EP | 0 443 420 A2 | 8/1991 | G07F/17/34 |

OTHER PUBLICATIONS

Smith, C., "Bar Bosses See New Trivia Game Filling More Seats," The Vancouver Sun, 1 page, (Feb. 21, 1990).
Scarne, Jr., "Scarne's Encyclopedia of Games," Harper & Row Publishers, First Edition, Stud Poker, pp. 33–41, 1973.
Scarne, "Scarne's Guide to modern Poker," Constable and Company, Limited, 1979, "Pokino," pp. 160–162.

(List continued on next page.)

*Primary Examiner*—Benjamin H. Layno
*Assistant Examiner*—D Collins
(74) *Attorney, Agent, or Firm*—Mark A. Litman & Assoc. P.A.

(57) ABSTRACT

A method of playing a wagering game, such as a casino table game or video game, including a playing card wagering game method involves each player placing a multiple part bet, such as a two, a three or a four-part bet. At least one game symbol is designated as wild. A certain position in the order of play is reached (such as with cards being dealt by the dealer, two face down to the dealer and three face down to each player), and the player is given an opportunity to withdraw at least one part of the multiple part bet from risk, although at least one part of the multiple part bet must remain at risk during the play of the game. Players evaluate their position in the game and the dealer or the program for the game gives each player the choice of withdrawing or leaving a first part of the bet. The game is then completed. For example in a card game, the player's cards are shown, and all remaining bets, which were not withdrawn, are resolved according to a pay table.

69 Claims, 4 Drawing Sheets

U.S. PATENT DOCUMENTS

| | | | | | |
|---|---|---|---|---|---|
| 4,836,553 | A | | 6/1989 | Suttle et al. | 273/292 |
| 4,837,728 | A | | 6/1989 | Barrie et al. | 364/412 |
| 4,842,276 | A | | 6/1989 | Darby | 273/1 |
| 4,882,473 | A | | 11/1989 | Bergeron et al. | 235/380 |
| 4,906,005 | A | | 3/1990 | Manabe | 273/142 |
| 4,948,134 | A | | 8/1990 | Suttle et al. | 273/85 |
| 5,019,973 | A | | 5/1991 | Wilcox et al. | 364/412 |
| 5,022,653 | A | | 6/1991 | Suttle et al. | 273/85 |
| 5,042,635 | A | | 8/1991 | Bell | 194/346 |
| 5,042,818 | A | | 8/1991 | Weingardt | 273/292 |
| 5,078,405 | A | | 1/1992 | Jones et al. | 273/309 |
| 5,098,107 | A | | 3/1992 | Boylan et al. | 273/292 |
| 5,100,137 | A | | 3/1992 | Fulton | 273/85 |
| 5,112,060 | A | | 5/1992 | Jones | 273/309 |
| 5,114,155 | A | | 5/1992 | Tillery et al. | 273/371 |
| 5,116,055 | A | | 5/1992 | Tracy | 273/138 |
| 5,167,413 | A | | 12/1992 | Fulton | 273/85 |
| 5,248,142 | A | | 9/1993 | Breeding | 273/138 |
| 5,275,400 | A | | 1/1994 | Weingardt et al. | 273/85 |
| 5,275,415 | A | | 1/1994 | Wisted | 273/274 |
| 5,288,077 | A | | 2/1994 | Jones | 273/292 |
| 5,288,081 | A | * | 2/1994 | Breeding | 273/292 |
| 5,308,065 | A | | 5/1994 | Bridgeman et al. | 273/85 |
| 5,326,104 | A | | 7/1994 | Pease et al. | 273/138 |
| 5,364,104 | A | | 11/1994 | Jones et al. | 273/292 |
| 5,382,025 | A | | 1/1995 | Sklansky et al. | 273/292 |
| 5,393,067 | A | | 2/1995 | Paulsen et al. | 273/292 |
| 5,417,430 | A | | 5/1995 | Breeding | 273/292 |
| 5,437,462 | A | * | 8/1995 | Breeding | 273/292 |
| 5,472,194 | A | | 12/1995 | Breeding et al. | 273/138 |
| 5,544,892 | A | | 8/1996 | Breeding | 273/292 |
| 5,630,586 | A | | 5/1997 | Lowden | 273/138.2 |
| 5,669,817 | A | | 9/1997 | Tarantino | 463/13 |
| 5,743,800 | A | | 4/1998 | Huard et al. | 463/26 |
| 5,769,422 | A | | 6/1998 | Stromer | 273/274 |
| 5,775,992 | A | | 7/1998 | Wood et al. | 463/13 |
| 5,848,932 | A | | 12/1998 | Adams | 463/20 |
| 5,851,011 | A | | 12/1998 | Lott | 273/292 |
| 5,901,958 | A | | 5/1999 | Andrews | 273/292 |
| 5,947,821 | A | | 9/1999 | Stone | 463/13 |
| 5,957,459 | A | | 9/1999 | Chae | 273/292 |
| 5,979,897 | A | | 11/1999 | Grossman | 273/292 |
| 5,984,309 | A | | 11/1999 | Santin | 273/292 |
| 5,984,310 | A | | 11/1999 | English | 273/292 |
| 5,988,643 | A | | 11/1999 | Awada | 273/292 |
| 6,012,719 | A | | 1/2000 | Webb | 273/292 |
| 6,019,374 | A | * | 2/2000 | Breeding | 273/292 |
| 6,036,190 | A | | 3/2000 | Edmunds et al. | 273/292 |
| 6,273,424 | B1 | * | 8/2001 | Breeding | 273/292 |
| 6,299,534 | B1 | * | 10/2001 | Breeding | 463/25 |

OTHER PUBLICATIONS

"Wild Deuces," Michigan Legoinaire, vol. XXXII, No. 10, 1 page, (Oct. 1978).

Gros, R., "Working Within the Systems," Casino Journal, vol. 8, No. 12, pp. 10–11, 13, 15, 4 (Dec. 1992).

Second Amended Petition filed in the Civil Action "in the Matter of the Petition of IGT for Certain Declaratory Rulings and for the Authorization for the Implementation of the Game of Progressive–21," pp. 1–9 (1992).

Scarne, Jr., "Scarne's Encyclopedia of Games," Harper & Row Publishers, First Edition, "Pontoon," p. 288, "Scarney Baccarart" ®, pp. 299–304, and "Three–In–One", p. 383.

"Over/Under Blackjack," Product Brochure Published by Gaming Concepts, Inc., 3 pages (1988).

"Declaration of Jim Kilby Under CFR 1.132," 2 pages (May 9, 1995).

"Wheel of Gold," Product Information published by Anchor Games, 11 pages (Oct. 1995).

John Scarne Games, Inc., Scarne's Guide to Modern Poker, 1980, Draw Poker Variation of Spit in the Ocean, pp. 139–153.

"Poker is the name of the Game," Walter Gibson, 1974, Chapter VIII, Spit in the Ocean (not clearly readable).

"Hoyl's Moder Encyclopedia of Card Games," Walter Gibson, 1993, pp. 268–271 (not clearly readable).

* cited by examiner

BET WITHDRAWAL CASINO GAME WITH WILD SYMBOL

Related Applications

This Application is a continuation-in-part of U.S. patent application Ser. No. 09/317,705 filed on May 24, 1999, which will issue as U.S. Pat. No. 6,273,424 on Aug. 14, 2001. That Application is, in turn, a continuation-in-part of U.S. patent application Ser. No. 08/970,966 filed on Nov. 14, 1997, which is now U.S. Pat. No. 6,019,374, which was in-turn a continuation-in-part of U.S. patent application Ser. No. 08/198,368 filed on Feb. 18, 1994 which is now U.S. Pat. No. 5,437,462, which was in-turn a continuation of U.S. patent application Ser. No. 08/023,196, filed on Feb. 5, 1993, which is now U.S. Pat. No. 5,288,081.

BACKGROUND OF THE INVENTION

1. Field of the Invention

The present invention relates to a method of playing a wagering game with any gaming format (e.g., cards, dice, symbols, table games and video games), such as playing card wagering games that can be played with a standard deck of cards or by video machine technology in a casino, commercial card room or home environment. In particular, the invention relates to a method and apparatus for playing a wagering game and provides players the opportunity to take or leave a portion of their wager during the course of the game and before conclusion of play. A preferred game is a variation of poker such as a variant of five-card stud poker. In one form of the invention, one or more wild symbols are provided in a game that allows a player to withdraw a portion of this bet. The presence of wild symbols increases the hit frequency of certain symbol combinations, providing a higher level of player interest in the game.

2. Background of the Art

There are many wagering games used for gambling. Such games should be exciting to arouse players'interest and should be uncomplicated so the games can be understood easily by a large number of players. Ideally, the games should include more than one wagering opportunity during the course of the game, yet be able to be played rapidly to a wager resolving outcome. Exciting play, the opportunity to make more than one wager and rapid wager resolution enhance players'interest and enjoyment because the frequency of betting opportunities and bet resolutions is increased.

Wagering games, particularly those intended primarily for play in casinos, should provide players with a sense of participation and control, the opportunity to make decisions, and reasonable odds of winning, even though the odds favor the casino, house, dealer or banker. The game must also meet the requirements of regulatory agencies.

Wagering games, including wagering games for casino play, with multiple wagering opportunities are known. U.S. Pat. Nos. 4,861,041 and 5,087,405 (both to Jones et al.) disclose methods and apparatus for progressive jackpot gaming, respectively. The former patent discloses that a player may make an additional wager at the beginning of a hand, the outcome of the additional wager being determined by a predetermined arrangement of cards in the player's hand. U.S. Pat. No. 4,836,553 (to Suttle and Jones) discloses a modified version of a five card stud poker game.

Additional symbols may be added to the usual means of playing a game to increase wagering opportunities. This is disclosed in U.S. Pat. No. 5,098,107 (to Boylan et al.).

Somewhat similarly, U.S. Pat. No. 3,667,757 (to Holmberg) discloses a board game and apparatus, including a way to allow a player to make a choice with respect to several different alternative types of game play and risk bearing strategies. The alternative play is based on providing cards with additional symbols and therefore, a new set of odds. The game and apparatus disclosed by Holmberg requires new sets of rules, relatively complicated procedures and time for a player to learn the game.

U.S. Pat. No. 5,154,429 (to LeVasseur) involves the dealer playing multiple hands against a player's single hand, whereby the number of hands played in the same amount of time is increased.

SUMMARY OF THE INVENTION

The desired attributes of wagering games outlined above are in large measure provided by the method and apparatus for playing a wagering game in accordance with the present invention. The game is uncomplicated, exciting and provides the opportunity for players to make multiple wagers and choices regarding those wagers. In one example of the invention, a wild card or multiple wild cards are provided to increase the frequency of occurrence of predetermined winning card combinations in a casino card game. For example, in the practice of the invention the Let It Ride Bonus® poker game is enhanced by adding wild cards such as a single joker, or by declaring certain cards wild, such as all four deuces, for example.

The wagering game of the present invention may be played with any convenient, traditional or non-traditional gaming format or gaming elements. For the purposes of this disclosure, "game elements" or "gaming elements" means information and physical elements used by a player or dealer to participate in the game such as the face value of cards, the face value of a die or dice, slot symbols, angular positions on a wheel or reel game, cards (e.g., from a standard or non-standard playing deck), symbols on a reel, dice, tiles or the like. A preferred medium of play is with a single, typical (standard) fifty-two card poker deck (with or without jokers, or with cards removed as with Spanish Twenty-One™ poker where tens are removed from the deck and other rules are instituted) and a specific preferred game broadly involves the generally well recognized and accepted set of rules, procedures and wager-resolving outcomes of five card poker.

The game method comprises each player placing an initial, multi-part wager, such as a two-part, three-part, four-part, or more-part wager to participate in the game. In one example of the invention, the number of parts of the wager may correspond to the number of game elements initially dealt, provided or revealed to the player. The game is initiated such as with dice being rolled (some or all of the dice in a bar game, for example), cards are dealt by a dealer or a portion of the game symbols comprising a game outcome are revealed in another manner, such as on a video or slot display. In a preferred game, the player places three equal wagers, and a dealer deals three player's cards face down to each player and two community cards face down to the dealer. Players inspect or "sweat" their cards, and the dealer asks "take it or leave it?" with regard to the first part of the initial bet. Players can choose to retrieve or remove from play the first part of their initial bet, or leave the first part in play or at risk, based on their estimation of the value of the three cards in their hand. The dealer then turns over a first one of the dealer's community cards and the dealer's query is repeated with regard to the second part of the initial bet. Players can choose to retrieve or remove from play the second part of their initial bet or leave the second part in play or at risk, based on their perceived value of the four cards consisting of the three cards in the player's hand and the exposed first dealer's card. Players have no option with the third part of the bet. Finally, all cards are shown and the payouts and collections are resolved according to the ranking of the poker hand of each player, i.e., the players are not playing against each other or the dealer. This widely played game is known as Let It Ride® stud poker.

More specifically, the initial wager placed by each player comprises three equal parts and is made or placed before any cards are dealt. Each player is dealt three cards face down in the customary fashion (one-at-a-time or in groups of three cards). Two common cards are dealt face down in front of the dealer for use by all of the players. Each player will use the two common cards in front of the dealer in combination with his or her three cards to create a five card hand. After all players have placed their bets and received and examined their cards, each player is given the opportunity to retrieve the first one-third segment of the initial wager before the dealer reveals one of the two down cards previously placed in front of him. After all of the players have been queried and decided whether to "take it or leave it", the dealer turns one of the down cards face up. Each player now has the benefit of knowing the identity of four cards, the three he or she is holding down plus the first revealed common card, and the dealer again gives each player the opportunity to retrieve the second one-third segment of the beginning wager before exposing the second common down card. After the second common down card is revealed, the players turn up the three cards they are holding, thereby forming five-card poker hands made up of the three cards dealt to each player and the two dealer cards. The dealer examines each of the player's hands and determines what payout, if any, each player is entitled to receive according to that player's remaining wager and a preselected payout schedule. Payouts are made to players with winning hands and the losing wagers are collected. The cards are then reshuffled for the next hand.

A variation of this partial bet withdrawal method may be played with dice, where separate bet parts are associated with the roll of each die. For example, where a standard die with 1, 2, 3, 4, 5 and 6 dots on each face is used in Bar Dice, a separate bet may be associated with one or more of the individual dice. As each die stops turning or bouncing on a surface (in a real or virtual sense), or as each die is rolled and stops, the player may elect to withdraw one bet associated with that die or an adjacent die. Particularly where a dealer's dice hand is already shown or is partially shown, a player may reconsider the likelihood of a win, and determine whether or not all of his bet parts should remain in play. It should be noted that the play of the game involves distinct bet parts in its preferred play, as opposed to a Surrender play in Twenty-One, where half of the original bet is surrendered and half the bet is withdrawn, with no continuation of the play of the game. In the partial bet withdrawal method, the play of the game continues with the potential for a player to win payouts on any bets remaining at the resolution of the game.

Apparatus is disclosed for playing the wagering game according to the method outlined above. A typical gaming table, with a playing surface, is modified to include specific areas that provide locations for placing the wagers and for displaying the common cards. A card shuffling machine, such as that disclosed in U.S. Pat. No. 4,807,884 (invented by the inventor of the present invention and commonly owned) for facilitating and speeding the play of the wagering game may be used. A display device may be associated with the apparatus for displaying game information, such as common cards or pay tables, for example.

U.S. Pat. No. 5,437,462 describes a method of playing a wagering card game using actual or representations of standard face playing cards having a standard rank, said game involving standard poker hand rankings and comprising the steps of:

a player placing a wager to participate in the game;

providing cards for the player;

giving the player the chance to examine the cards received by the player and to withdraw at least part of said wager based on the rank of the player's cards;

showing the player at least one common card, thereby providing a hand for the player, the player's hand comprising said shown at least one common card and the cards the player received; and resolving the player's remaining wager, which was not withdrawn, based on the rank of the player's hand.

In another form of the invention, the game is a variation of the Let It Ride® poker basic game described above (hereinafter referred to as the "Base" game) or the bonus game. In the "Bonus" form of the game, the player has an option to make a side bet on the occurrence of certain predetermined card combinations. The card combinations that qualify for bonus payments are a subset of winning card combinations appearing on the pay table in the base game, commonly the highest raking card combinations. In the "Tournament" form of the game, an optional side bet is made. The player qualifies for bonus payouts as described in the Bonus form of the game. Additionally, for certain high ranking hands, such as a royal flush, the player qualifies to return and participate in a playoff event, as described in commonly owned U.S. Pat. No. 5,544,892, whose specification is incorporated by reference.

In another form of the invention, the Base or Bonus forms of the game are played with either a standard deck of cards including additional wild cards such as one, two or more jokers, or are played with a standard 52-card deck, with certain cards designated as wild.

In another form of the invention, the house collects a rake, and players take turns banking the game. Players are given the option of taking turns being the banker, and all player losses are collected and retained by the banker. In commercial card rooms, bankers are typically employees of companies who bank commercial card games.

It is one aspect of the present invention to provide an exciting and interesting wagering game. Another aspect of the present invention is to provide a wagering game that is easy to learn, largely being based on five card stud poker, wild card variants of five card poker games and the well known ranking of poker hands. It is another aspect of the present invention to provide a new variation of a well known wagering game, five card poker and wild card variants thereof, which is made interesting by providing the opportunity for players to make multiple wagers and decisions related to those wagers based on the progress of the game. Still another aspect of the present invention is to provide a wagering game that is easy to learn, yet demands skill of players in making strategic decisions about whether to let part of their bet remain at risk.

It is yet another aspect of the present invention to provide a unique, exciting card game for play in casinos or at home and on various media including casino tables, video poker machines, video lottery terminals or home computers.

It is an advantage of the game of the present invention that wagering decisions are inherent in the game. The game enhances player's sense of participation and takes advantage of a players'inclination to let wagers remain at risk once placed. The game of the present invention advantageously creates a greater sense of control on the part of players, possibly resulting in the players wagering more money per hand.

DETAILED DESCRIPTION OF THE INVENTION

Figure 1:
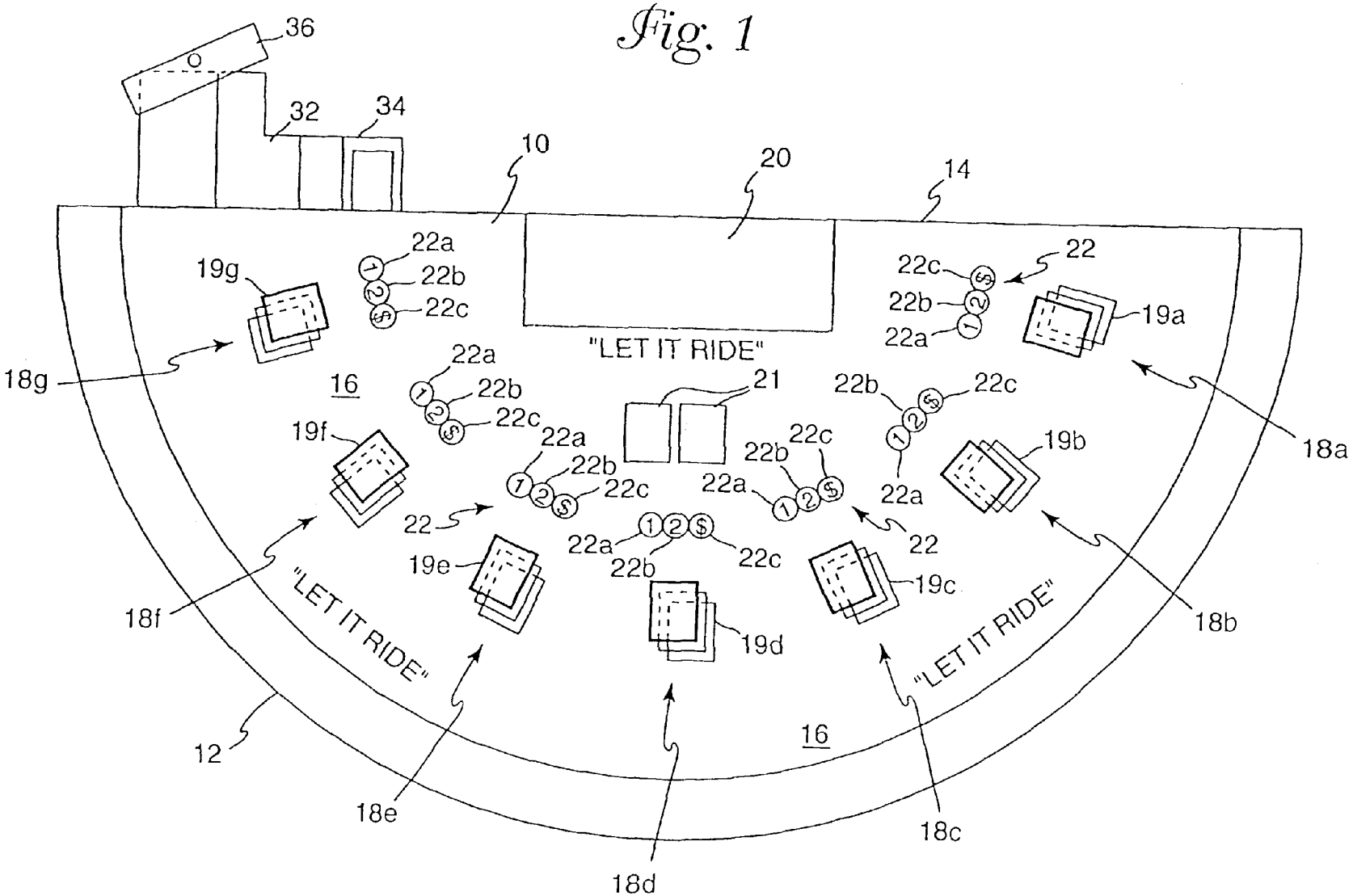
FIG. 1 depicts the table layout and apparatus used in playing the wagering game of the present invention.

A method of playing a wagering game comprises a player placing a wager comprising at least two distinct parts and providing to the player at least a portion of the total number of game elements used in the play of the game so that a partial evaluation of the player's game outcome in at least a single game is provided, giving the player at least one opportunity, before the player's complete set of game elements or final game outcome is determined, to withdraw from engagement in the game at least one part of said at least two parts, but less than all of said at least two parts, and continuing play of the game with additional portions of the elements that are used to determine the player's game outcome, typically comprising a set of game symbols, being revealed to the player.

Another method of playing a wagering game comprises a player placing a wager comprising at least two distinct parts and providing to the player a view of at least a portion of game elements in a dealer's hand so that a partial evaluation of the player's potential for winning against the dealer's hand in at least a single game is provided. This gives the player at least one opportunity, before the display of all of the player's and/or the dealer's final game outcome (rank or value of the dealer's hand) is determined or displayed, to withdraw from engagement in the game at least one wager part of said at least two wager parts, but less than all of said at least two wager parts, and continuing play of the game to a resolution of remaining wagers.

Yet another method of the invention includes introducing one or more wild symbols to the game. When the game is a card game, one or more cards in the deck are designated as wild, or at least one additional wild card is added. The wild cards increase the frequency of occurrence of the predetermined combinations, adding increased excitement and payout opportunities to the game. When the game is a slot-type game, the frequency of occurrence of designated symbol combinations (such as line wins, scatter pays and the like) is increased. The wild cards may already be a part of a standard deck of cards (such as a "deuces wild" version, where all four deuces are wild) or may be cards added to a standard deck, such as a "joker's wild" version. The "joker's wild" version may have one, two or more jokers added. The wild cards or symbols may function as wild symbols in all situations, or in more narrow situations. An example of a narrower situation is to use the wild symbol to complete straights, flushes and groups of Aces only, as is done in some versions of Pai Gow poker.

The method may comprise a casino table card game, a video table game, a video card game, an electromechanical or video reel slot game, a video or live dice game, a wheel game (such as roulette), bingo, keno, lottery type game or any other game whose outcomes are based on the random assignment of symbols to a player. If the game is a card game, the card game may comprise a poker game, a blackjack game, pai gow poker, Caribbean Stud® Poker or other card game. Awards may be made for predetermined ranks of hands in the card game. Awards may also be made for a player having a higher ranking hand than a dealer in the card game. Each of said at least two parts of said wager may be equal or any two or more may be unequal, and the number of at least two parts may be two, three, four, five, six or more parts. The method may include the at least two-part wager, such as an initial three-part wager amount, wagered by each participating player comprising three equal parts and may be wagered before any cards are dealt, dice are thrown, wheel or reel is spun or numbers are drawn.

Referring to FIG. 1, an example of one form of the apparatus for the wagering game of the present invention includes a typical casino gambling or gaming table 10. The table 10 has a curved side 12 for accommodating up to seven players and a straight side 14 for accommodating the dealer. The table 10 has a flat playing surface 16 covered with felt or other appropriate material. Although seven playing positions or locations 18*a–g* for individual players are provided, it is not essential to the game that exactly seven persons play and as many as sixteen players may participate. For casino play, a maximum of seven players provides for a game that is easily manageable by the dealer and house, and one in which the individual players feel more involved. A house dealer position 20, including an area suitable for displaying the dealer's cards 21, is provided.

Each of the playing positions 18*a–g* includes a wagering zone 22, comprising three separate and distinct wagering or betting areas 22*a, b, c*. Each position 18*a–g* also includes a card area 19*a–g* for receiving and displaying cards dealt to the player occupying the position. The wagering areas 22*a, b, c* are designed to receive appropriate wagering indicators or settling means such as chips (not shown).

At one side of the dealer station 20, the apparatus for practicing the method of the present invention may include a microprocessor computer controlled shuffling machine 32 supported by a table extension 34. The shuffling machine 32 may be of the type disclosed in U.S. Pat. No. 4,807,884, the disclosure of which patent is incorporated herein by reference, or a more technologically advanced shuffling machine such as the Ace® card shuffler as described in commonly owned U.S. Pat. No. 6,254,096, the disclosure of which patent is also incorporated by reference. The shuffling machine 32 may include a dealing module for automatically and sequentially dealing randomly arranged groups of cards and also may include a display means for displaying wager amounts, the identity of winning players, or other game related information.

Figure 2:
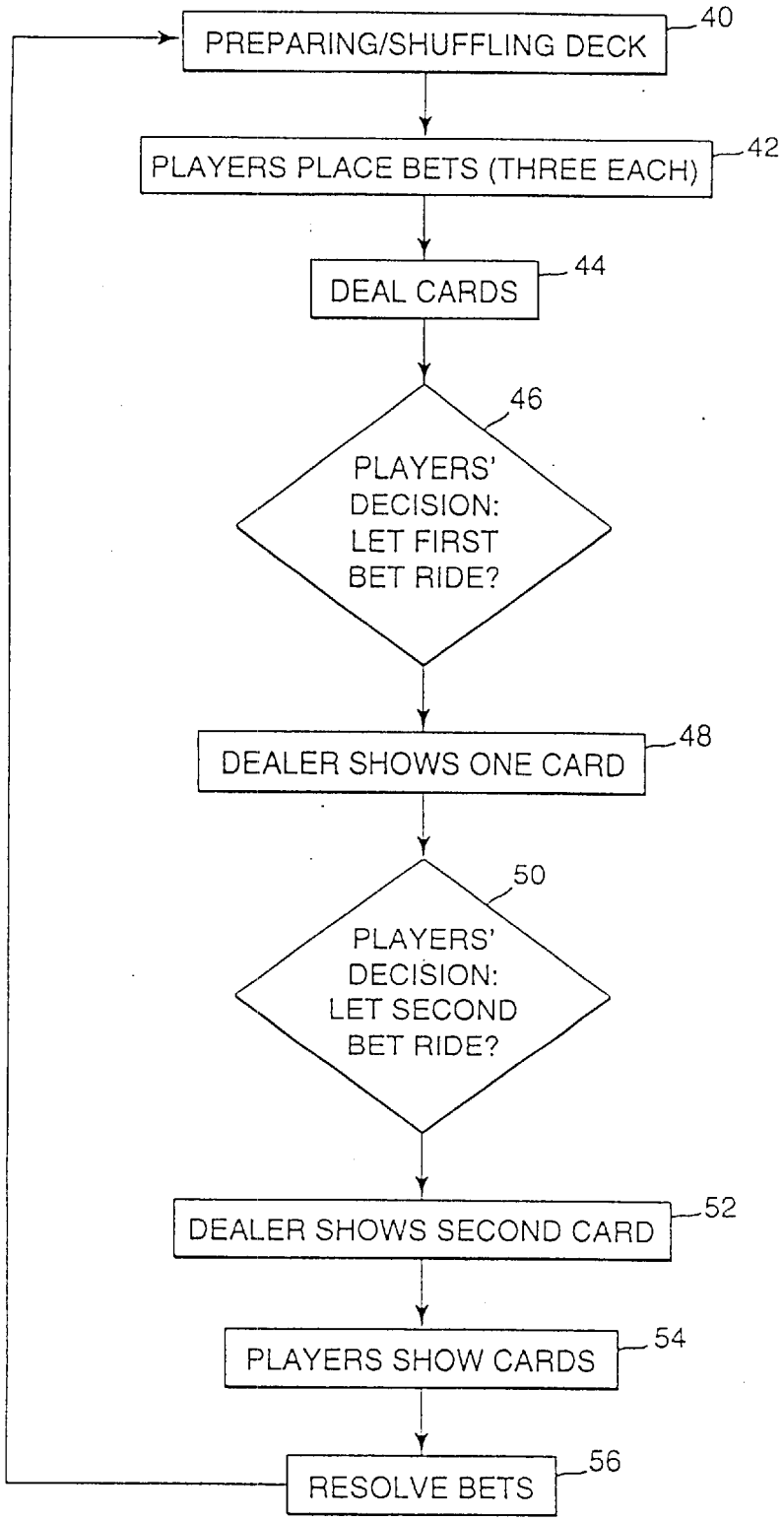
FIG. 2 is a block diagram representing the flow of play in the game.

Referring to the flow diagram of FIG. 2, the initial step in playing the game of the present invention is preparing or shuffling a deck of cards, represented at block 40, by activating the shuffling machine 32 or by hand-shuffling a deck to provide a shuffled deck, or shuffled hands of cards. Next, the players place the initial wager, block 42, by putting equal amounts in each of the three betting areas 22*a, b, c*. Two of the parts of this initial wager, the parts placed in wagering area 22*a* and 22*b* are retrievable at the option of the player. The third portion placed in area 22*c* cannot be withdrawn. After the placing of the wager by each player, the cards are dealt, block 44, three cards being dealt down to each player and two cards are dealt down in front of the dealer. The players inspect or "sweat" their cards in preparation for reaching decision block 46. At decision block 46, the players are queried by the dealer about whether the first part of the initial wager, the part placed in wagering area 22*a,* should be left or whether the player wishes to withdraw that portion of the bet. Each player makes the decision at decision block 46 on the basis of the three cards forming the player's incomplete hand at this point. Once each player has been queried and has decided whether or not to let the first portion of the bet ride, and those bets the player chooses to retrieve or remove are physically removed from area 22*a* and returned to the player, the dealer shows one of the down common cards, block 48. Now, each player has four cards to consider, the three cards dealt to that player originally and the single common card showing on the table. Each player must then decide whether to let the second part of the initial wager ride or whether to withdraw it from the game. After each player is queried and decides what to do with regard to the second part of the bet, and those bets to be withdrawn are physically removed from area 22*b* and returned to the player, the dealer reveals the second common down card, as represented at block 52. Each player now has a five-card hand comprised of the three cards each player was originally dealt plus the two revealed common cards. The third bet, the bet placed at wagering area 22*c*, is a nonretrievable portion of the initial bet and the flow of the game proceeds to block 54 wherein the players show or reveal their three cards to the dealer. The dealer resolves each player's bet (which includes all three parts, the second and third part or only the third part, depending on the player's choices during play of the hand) based on the five card hand at block 56 and determines what payout, if any, the player is entitled to receive according to the payout schedule at the particular gaming table or casino. Bets on non-winning hands are collected by the dealer or house. The hand is then over and the flow of the game returns to block 40, preparing and shuffling the deck for a new hand.

The award or payoff is given for each of the optional bets that were allowed to ride to the end of the hand and for the nonwithdrawable part of the bet. A typical pay table for a game without wild cards would be as follows:

| | | |
|---|---|---|
| Pair, Tens or Better | 1–1 | (even money) |
| Two Pairs | 2–1 | |
| Three of a Kind | 3–1 | |
| Straight | 5–1 | |
| Flush | 8–1 | |
| Full House | 11–1 | |
| Four of a Kind | 50–1 | |
| Straight Flush | 200–1 | |
| Royal Flush | 1,000–1 | |

The method of the present invention is not limited to five card poker games, but may be applied or used in other appropriate games such as seven card poker, dice games, wheel games, slot games, video games, live games, bingo, keno, computerized or mechanical games. The method of the present invention does not require a shuffling machine 32, dealing module 33 or a display means 36. However, these facilitate and expedite the play of a card game as well as add interest to the game. While the initial wager of the present invention is preferably comprised of three equal bets, the bets do not necessarily have to be equal. While equal bets might be considered essential by some for casino play, unequal bets may be used, if desired. The wagering game of the present invention might be played live in casinos with a dealer, or in casinos or homes in interactive electronic or video form with automatic coin or betting means receptacles and payout capability, wherein appropriate symbols for cards, wagers or score keeping would be displayed electronically. A "board-type game" suitable for home, club or casino use may also be provided for practicing the method of the present invention.

Figure 4:
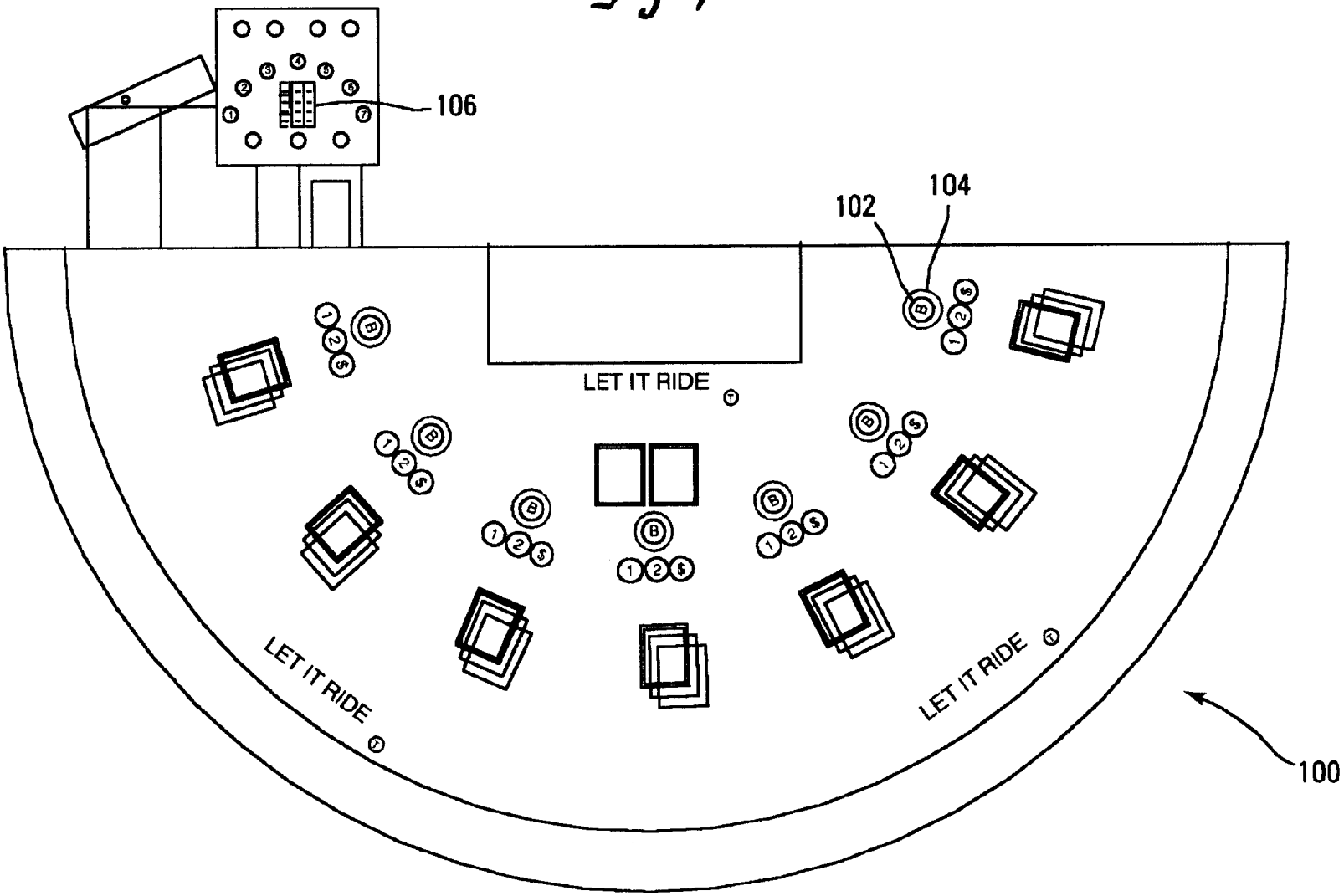
FIG. 4 is a plan view of a gaming table for playing one exemplary wild card version of the game of the present invention.

Another variation of the example provided above includes adding a bonus element to the basic game of Let It Ride® poker. In the "Bonus" form of the game, the player makes an optional wager on a typical layout 100 as shown in FIG. 4. Optionally, each player station is equipped with a sensor 102 located within or beneath the betting circle 104. Once the token is placed on the sensor 102, the dealer presses a "lockout" key on the keypad controls 106, eliminating late betting. The bets are then removed from the table. Preferably, the betting circle 104 is illuminated when a bet has been registered. A suitable bet sensor is described in commonly owned U.S. patent application Ser. No. 08/998,473, filed Dec. 26, 1997 for Gaming Apparatus and Method with Proximity Switch, now U.S. Pat. No. 6,299,534, the specification of which is incorporated by reference.

In one form of the Bonus style game, all four deuces are designated as wild. The play of the game is identical to the Bonus game, except that in scoring the hands, all deuces are wild, without condition. In other words, all deuces function as wild cards in all situations. For example, regardless of the hand the player is trying to make, if he or she holds a deuce, or one of the common cards is a deuce, the player can designate this deuce as any card in the deck.

Because the hit frequency of the preselected winning poker hands is increased by designating four cards in the deck as wild, the pay tables must be modified so that the basic and bonus bets still individually provide the house with an advantage. In the alternative, the bonus bet is mandatory, and the combined base game and bonus game provides an overall house advantage, but the base bet and bonus bet individually need not provide a house advantage.

An exemplary pay table for the deuces wild version of the Bonus game are provided below:

Deuces Wild Let it Ride ® Bonus

| Hand | Basic Payout | Bonus |
|---|---|---|
| Natural Royal | 500 | 10,000 |
| Four Deuces | 100 | 5,000 |
| Wild Royal | 30 | 250 |
| 5 of a Kind | 20 | 100 |
| Straight Flush | 10 | 50 |
| 4 of a Kind | 4 | 20 |
| Full House | 4 | 10 |
| Flush | 3 | 6 |
| Straight | 2 | 5 |
| 3 of a Kind | 1 | 1 |
| 2 Pair | 1 | |
| Pair of Aces | Push | |
| Hit Frequency | 31% | 18.4% |
| House Advantage | 2.4% | 20.1% |

In this example of the invention, a deuce is wild in all hand combinations. The frequency of occurrence of a winning hand is 31%. As compared to Let it Ride® without wild cards, the overall hit frequency of the base game can be higher, lower or about the same, but the hit frequency on the bonus bet increases. With the payouts listed above, the house maintains a 2.4% theoretical advantage on the base game, and a 20.1% advantage on the bonus bet. In other examples of the invention, other cards are wild (such as Jacks), and/or the wild cards are wild only in certain hands, such as in a royal flush or four of a kind. The pay table shown above is merely an illustration of possible payouts that are proportional to the amount wagered. Modifications to payouts are made that changes the house advantage. For example, the payouts or winning hand designations could be modified to increase or decrease the house advantage, depending on the wishes of the customer.

In another example of the invention, the side bet funds a progressive jackpot, and top paying hands such as a royal flush wins the progressive prize.

In yet another example of the invention, one additional wild card (a joker) is added to a standard 52-card deck. In the game of Joker's Wild Let it Ride® Bonus poker, the player places three equal bets, and an optional bonus bet, on a typical layout as shown in FIG. 4. The dealer deals each player three cards, face down, and two cards to himself, face down. Players are permitted to view their cards. Based on the partial information about the hand, the player is allowed to withdraw a first portion of the bet. The dealer then reveals one of his down cards, and that card becomes a community card common to all hands. The player then has the chance to withdraw another portion of his or her bet based on the four-card hand. The fifth card is revealed, and the hands are resolved. If the player has the joker in either his hand or as a common card, he may designate that card to be any card in a standard deck. For example, of the player holds three Aces and a "community" joker card, the hand is scored as a four of a kind. An exemplary pay table for the Joker's Wild Let it Ride Bonus game is shown below:

Jokers Wild Let it Ride ® Bonus

| Hand | Basic Payout | Bonus |
|---|---|---|
| Natural Royal | 1,000 | 20,000 |
| Wild Royal | 50 | 2,000 |
| 5 of a Kind | 20 | 1,000 |
| Straight Flush | 8 | 500 |
| 4 of a Kind | 6 | 100 |
| Full House | 5 | 50 |
| Flush | 4 | 30 |
| Straight | 2 | 20 |
| 3 of a Kind | 2 | 5 |
| 2 Pair | 2 | 1 |
| Pair of Queens or better | 1 | 0 |
| Hit Frequency | 23.55% | 10.4% |
| House Advantage | 2.73% | 19.5% |

In order to modify the hit frequency of the wild card game of the present invention, the number of wild cards can be changed, the number of wild cards added to the deck can be increased or decreased, or the number of situations that permit the substitution of a wild card can be changed. For example, the use of wild cards can be limited to completing flushes and straights in one example of the invention.

Although the wild card version of the invention is shown as a variant of the Let It Ride ® Bonus poker game, the wild card element could also be used as a feature of basic Let It Ride®, a dice game or virtually any other wagering game that randomly assigns symbols to a player to determine a game outcome. For example, a wild symbol could appear on the virtual reel of a video reel slot wagering game.

In yet another embodiment, the bet withdrawal game of the present invention is played as a player banked game. In the player-banked version of the game, the game is a live table game. The house collects a flat fee or a percentage of the amount wagered, or a "rake", and a player acts as the banker. A dealer is provided to administer the game, including dealing cards, resolving hands and making payouts. Players are given the option of taking turns being the banker. All player losses are collected and retained by the banker. In commercial card rooms, bankers are typically employees of companies who bank commercial card games. The player who is acting as banker must cover all player payouts. To reduce exposure to losses, the player banked version of the game can be constructed to reduce the player's risk in making top payouts. For example, an alternate payout scheme for Let it Ride® (basic) could be constructed to reduce top payouts to a level acceptable to players who bank the games.

Another embodiment of the present invention is a modification of a gaming table incorporating a plurality of slot reels as shown in Lowden, U.S. Pat. No. 5,630,586, the content of which is hereby incorporated by reference.

Figure 3:
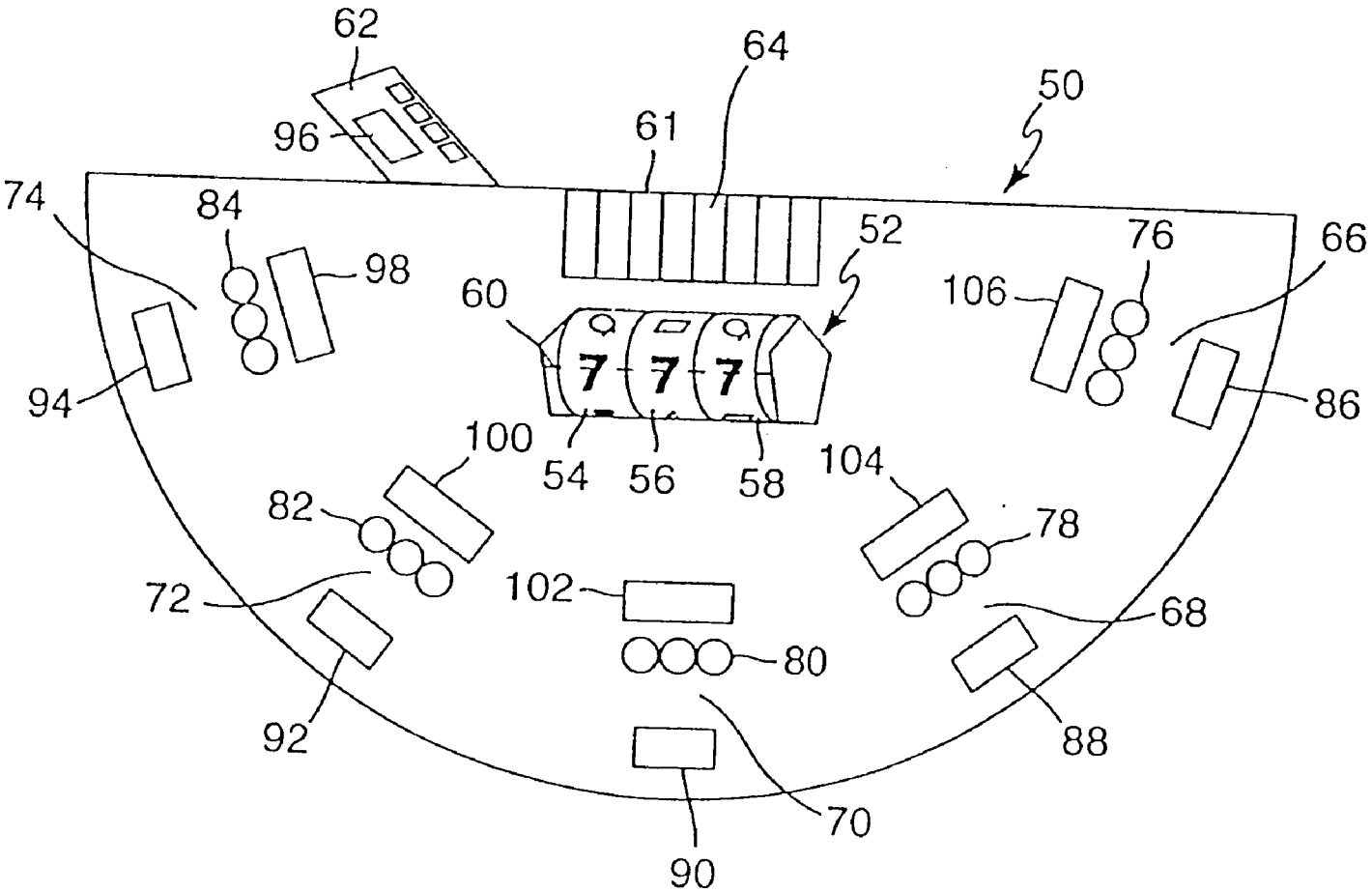
FIG. 3 is a plan view of a gaming table according to the present invention.

As shown in FIG. 3, a gaming table 50 is equipped with an electromechanical reel-spinning device 52. The reel spinning device 52 preferably includes three reels 54, 56 and 58, and a single pay line 60. The table also includes a dealer station 61, dealer controls 62, a coin tray 64 and five player stations 66, 68, 70, 72 and 74. Each player station includes a set of three betting circles 76, 78, 80, 82 and 84, and a stop button 86, 88, 90, 92 and 94.

According to the apparatus of the present invention, the reel-spinning device 52 is controlled by a game computer (not shown). Each reel begins to spin in response to the dealer depressing the spin button 96 on the dealer controls 62. A random number generator is employed to select the symbol, which is displayed on the first reel 54 on the pay line 60. The two remaining reels 56 and 58 continue to spin.

Printed on the table surface is a pay table 98, 100, 102, 104 and 106 located at each player station 74, 72, 70, 68 and 66, respectively. Based on the winning outcomes printed on the pay table and the partial outcome shown on the first reel, the player is given the opportunity to withdraw one of the three bets. One of the players is asked to press the stop button. For example, the player at station 66 depresses the stop button 86. The computer utilizes a random number generator to select the symbol, and causes the symbol to appear on the second reel 56 on the pay line 60. The game computer then sends a signal to the breaking device (not shown) to stop the reel at the selected angular position.

The player is given the opportunity to compare the partial information (e.g., two of the three reel outcomes) and withdraw a second portion of his bet. Another player is then asked to press the stop button, stopping the third reel. At this point, each player has at least one bet remaining, and all wagers are then resolved. Because each player shares the same outcome, all players either win or lose the round of play as a group. The pay table could be constructed to avoid player's higher proportional payouts for leaving more portions of their bets at risk, or can pay the same proportional payout for a given outcome regardless of the number of bets remaining at the conclusion of play.

Although this illustrated embodiment describes an electromechanical three reel slot table game, the invention contemplates the use of fewer than three or more than three reels, the use of a video screen to simulate reels, or the use of a video screen embedded into a gaming table for the purpose of providing a virtual display of almost any type of known wagering game, including but not limited to card games, dice games, wheel spinning games and the like.

The bet withdrawal wagering game of the present invention may be practiced as a board game (parlor game) or as a form of game show entertainment. For example, in the game show format, the sponsor gives each player a sum of money to play the game, such as $5,000, for example. This money must be used to play the game. When a player makes a wager and wins the wager, the amount wagered, plus the payout is added back to. the player's account. At the conclusion of play, the player with the highest account value wins. In one example of play, the players play multiple rounds, with the amount wagered increasing with each successive round. For example, a that consists of 6 rounds requires the player to make three equal bets in the amounts of $10, $50, $100, $200, $500 and $1,000. If he loses all 6 rounds, he will net $4,150 for playing. If he wins all rounds and each round pays even money, $5,580 will be added to his account, for a total of $15,580.

Virtually any game that provides the player with partial information that bears directly or indirectly on the game outcome can be used according to the method of the present invention. For example, when the game is a trivia game, the players are required to make three equal wagers. The announcer gives each player five cards (or a display with five buttons), marked A, B, C, D and E. The announcer provides the player with the topic, such as sports, and the players can either leave all bets at risk or withdraw one of the bets. Then, the announcer gives the player clues about the answer. For example, the announcer says that the player's name is Joe. The players optionally withdraw another segment of the bet. The announcer then tells the players to name a famous football player named Joe. The last part of the bet remains at risk. He gives the players five possible answers, and the players select an answer by displaying or selecting the letters A–E. If, for example, answer B is Joe Namouth, the persons who selected B win the round and are paid even money on all bets at risk. In another form of the game, upon winning, they get to keep the money that remains at risk, at which time the amount is transferred to a "prize" account. The prize money can be cashed in at any time, and cannot be used to play additional rounds.

In another example of a variety game show, the object of the game is to complete a word puzzle. The players place 4 equal bets. At the beginning of the game, the host reveals certain letters, such as the number of vowels needed to complete the phrase. If the player thinks he can solve the puzzle, we will leave his bets at risk. If he has no idea how to solve the puzzle, he may wish to withdraw a first segment of his bet. The game show host then reveals a number of additional letters. For example, all consonants between A and G are revealed that is part of the puzzle outcome. The players use this information to decide whether it is likely he can solve the puzzle. If he cannot, he may wish to withdraw the second portion of the bet. The host then reveals all letters between H and K that are part of the game outcome. The player uses this information to determine whether to withdraw the third portion of the bet. The fourth portion of the bet remains at risk.

The players then attempt to solve the puzzle. The first person to correctly solve the puzzle wins the money remaining at risk, plus an amount equal to that amount. In another example of the invention, the money put at risk is doubled, tripled or otherwise multiplied by a factor as part of the game or a bonus event.

In each example of the invention, the player must keep at least one segment of the bet at risk. The variety show and home version of the present invention may be played with or without the use of wild symbols. If a wild symbol is utilized, it may substitute for all remaining game symbols, for certain game symbols, or for game symbols only under certain conditions.

The present invention may be embodied in other specific forms without departing from the essential attributes thereof. It is desired that the embodiments described above may be considered in all respects as illustrative, not restrictive, reference being made to the appended claims to indicate the scope of the invention.

What is claimed is:

1. A method of playing a wagering game comprising a player placing a wager comprising at least two distinct wagering parts and providing to the player at least a portion of the player's game elements so that partial information or a game outcome is provided, giving the player at least one opportunity, before the player's final game outcome is determined, to withdraw from engagement in the game at least one wagering part of said at least two wagering parts, but less than all of said at least two wagering parts, and continuing play of the game with additional portions of the player's game elements being displayed to the player, wherein at least one of the game elements is designated wild.

2. A method of playing a wagering game comprising a player placing a wager comprising at least two distinct wagering parts and providing to the player a view of at least a portion of a dealer's game elements so that a partial game outcome is provided, giving the player at least one opportunity, before the display of all of the player's and/or the dealer's final game elements are provided, to withdraw from engagement in the game at least one wagering part of said at least two wagering parts, but less than all of said at least two wagering parts, and continuing play of the game to a resolution of remaining wagers, wherein at least one of the game elements is designated wild.

3. The method of claim 1 wherein said game comprises a casino table card game and the game elements comprise cards.

4. The method of claim 2 wherein said game comprises a casino table card game and the game elements comprise cards.

5. The method of claim 1 wherein said game comprises a video card game.

6. The method of claim 2 wherein said game comprises a video card game.

7. The method of claim 3 wherein said card game comprises a poker game.

8. The method of claim 4 wherein said card game comprises a poker game.

9. The method of claim 5 wherein said video card game comprises a poker game.

10. The method of claim 3 wherein awards are made for predetermined ranks of hands in the card game.

11. The method of claim 5 wherein awards are made for predetermined ranks of hands in the card game.

12. The method of claim 4 wherein awards are made for a player having a higher ranked hand than a dealer in the card game.

13. The method of claim 8 wherein awards are made for a player having a higher ranked hand than a dealer in the card game.

14. The method of claim 5 wherein awards are made for a player having a higher ranked hand than a dealer in the card game.

15. The method of claim 6 wherein awards are made for a player having a higher ranked hand than a dealer in the card game.

16. The method of claim 6 wherein awards are made for predetermined ranks of hands in the card game.

17. The method according to claim 3, wherein each of said at least two parts of said wager are equal.

18. The method according to claim 4, wherein each of said at least two parts of said wager are equal.

19. The method according to claim 3, wherein each of said at least two parts of said wager are unequal.

20. The method according to claim 4, wherein each of said at least two parts of said wager are unequal.

21. The method according to claim 4 wherein said at least two wagering parts comprises at least three wagering parts.

22. The method of claim 5 wherein each of said at least two wagering parts of said wager are equal.

23. The method of claim 6 wherein each of said at least two wagering parts of said wager are equal.

24. The method of claim 5 wherein each of said at least two wagering parts of said wager are unequal.

25. The method of claim 6 wherein each of said at least two wagering parts of said wager are unequal.

26. The method according to claim 5 wherein said at least two wagering parts comprises at least three wagering parts.

27. The method according to claim 6 wherein said at least two wagering parts comprises at least three wagering parts.

28. The method according to claim 21 wherein said at least two wagering parts comprises at least three wagering parts.

29. The method according to claim 22, wherein an initial three-part wager amount wagered by each participating player comprises three equal wagering parts and is wagered before any cards are dealt.

30. A betting method for a live casino card game comprising:

a player placing a wager to participate in a live casino game, the wager comprising at least two wager parts;

a dealer dealing at least a partial hand to the player from a deck of cards;

the player examining the at least a partial hand and optionally withdrawing at least one of said at least two wager parts, but less than all of said at least two wager parts of the wager;

the dealer dealing at least one additional card in addition to the at least a partial hand of the player to complete the player's hand; and the dealer making payouts to the player holding a winning hand, wherein the winning hand is determined by rules of the live casino card game, and wherein at least one card in the deck is designated as wild.

31. A betting method for a live casino card game comprising:

a player placing a wager to participate in a live casino game, the wager comprising at least two wager parts;

a dealer dealing at least one group of cards comprising:

a) a partial hand of cards to the player and b) at least one common card which forms part of each players' hand;

the player examining the at least one group of cards and, based upon partial information, optionally withdrawing at least one of said at least two wager parts, but less than all of said at least two wager parts of the wager;

the dealer dealing at least one additional card to the common cards or to the partial hand of the player and playing the game to a conclusion; and the dealer making payouts to the player or players holding a winning hand, wherein the winning hand is determined by rules for the live casino card game, and wherein at least one card in the group is designated as wild.

32. A betting method for a gaming machine comprising:

a player placing a wager to participate in a casino machine wagering game comprising a plurality of game elements, the wager comprising at least two wager parts;

activating the wagering game;

revealing at least a portion of the game elements to the player on a player display;

the player optionally withdrawing at least one of said at least two wager parts, but less than all of said at least two wager parts of the wager based upon consideration of the revealed game elements;

concluding play of the casino machine wagering game; and awarding payouts to the player for a winning combination of game elements, wherein the winning outcome is determined by rules for the casino machine wagering game, and wherein at least one of the game elements is designated as wild.

33. A betting method for a live casino game comprising a plurality of game elements, the live casino game having rules that provide that a portion of the game elements is revealed to the player prior to the conclusion of the game, wherein the game includes a dealer, the method comprising:

a player placing a wager to participate in the casino game, the wager having at least two wager parts;

the dealer initiating the game, wherein a portion of the game elements is revealed to the player;

the player examines the revealed portion of the game and optionally withdraws a portion of said at least two wager parts, but less than all wager parts of said wager;

completing the play of the game; and the dealer awarding payouts to a player or players having a combination of game elements that results in a winning outcome, wherein the winning outcome is defined by rules of the live casino game, and wherein at least one of the game elements is designated as wild.

34. A gaming apparatus for playing a live casino wagering game, comprising:

a gaming table including:

a playing surface;

a plurality of player locations on the playing surface;

a dealer station;

dealer game controls;

a chip tray mounted into the playing surface;

a plurality of betting areas located at each player location, wherein each player is required to place a bet comprising a plurality of wager parts;

a reel slot display for displaying game symbols, at least one of the game symbols designated as wild;

a game computer for controlling the operation of the game; and player controls located at each player location, wherein the player controls permit a player to stop less than all the reels from spinning to afford the player an opportunity to withdraw fewer than all wager parts of his bet before the last wheel comes to rest.

35. The apparatus of claim 34 wherein the bet is a three-part wager bet, and the reel mechanism is a three reel mechanism, wherein the player is permitted to withdraw one wager part of the bet after the first reel stops spinning.

36. The apparatus of claim 34, wherein the player is permitted to withdraw a second wager part of his bet after the second reel stops spinning.

37. The apparatus of claim 34, wherein the reel slot display is an electromechanical reel slot display.

38. The apparatus of claim 34, wherein the reel slot display is a video reel display.

39. A method of playing a slot-type casino wagering game comprising:

a player placing a wager of at least two distinct wager parts to participate in the game;

revealing to the player at least one slot symbol defining a partial game outcome to the player, wherein at least one slot symbol is designated as wild;

providing the player the opportunity to withdraw at least one wager part, but fewer than all wager parts of the wager based on the revealed slot symbol;

revealing to the player the remaining slot symbols defining the game outcome; and paying the player an award for a predetermined winning outcome, wherein the amount of the award is based on the wager parts of the wager remaining in play.

40. The method of claim 39, wherein the wager comprises three equal wager parts, and the game is a three-reel slot device.

41. The method of claim 39, wherein the game is a live casino table game.

42. The method of claim 39, wherein the player is provided with a second opportunity to withdraw at least one wager part of his bet.

43. A method of playing a wagering game including the random assignment of game symbols to each player from a symbol set, comprising the steps of:

placing a wager, beginning the game by revealing a portion of game symbols to each player, giving the player an opportunity to withdraw a portion of the wager and leaving a remaining part of the wager, continuing the game until its outcome by revealing the remaining symbols assigned to each player, wherein at least one game symbol in the symbol set is designated wild; and resolving the remaining part of the wager.

44. A method of playing a wagering game utilizing a group of cards, comprising the steps of:

placing a wager to become a player, providing at least one card to a player, providing the player an opportunity to examine the at least one provided card and withdraw only a part of the wager and leave a remaining part of the wager, providing at least one additional card to the player, and resolving the remaining part of the wager,wherein at least one card in the group is designated as wild.

45. A method of playing a wagering game utilizing a group of cards, comprising the steps of:

placing a wager to become a player, providing at least one card to a player, providing the player an opportunity to examine the at least one provided card and withdraw at least a part of the wager and leave a remaining part of the wager, providing at least one additional card to the player, and resolving the remaining part of the wager, wherein at least one card in the group is designated as wild.

46. The method according to claim 45 wherein the game comprises a casino game between a casino and a plurality of players.

47. The method according to claim 45 wherein the cards are standard playing cards.

48. The method according to claim 45 wherein the wager is divided into a number of wager parts and the at least one additional card comprises a number of cards, and wherein the number of wager parts of the wager that may be withdrawn is equal to the number of said at least one additional cards.

49. The method of claim 1, wherein the wild game elements are cards.

50. The method of claim 1, wherein the wild game elements are selected from the group consisting of deuces and jokers.

51. The method of claim 2, wherein the game elements are cards, and the wild game element is selected from the group consisting of deuces and jokers.

52. The betting method of claim 30, wherein the wild card is selected from the group consisting of deuces and jokers.

53. The betting method of claim 1, wherein the wild card is selected from the group consisting of deuces and jokers.

54. The betting method of claim 32, wherein the game elements are representations of cards, and wherein the wild cards are selected from the group consisting of deuces and jokers.

55. The betting method of claim 33, wherein the game elements are cards and wherein the wild cards are selected from the group consisting of deuces and jokers.

56. The gaming apparatus of claim 34, wherein the wild game symbol is selected from the group consisting of deuces and jokers.

57. The method of claim 43, wherein the game symbols are cards and the wild symbol is selected from the group consisting of deuces and jokers.

58. The method of claim 44, wherein the wild card is selected from the group consisting of deuces and jokers.

59. The method of claim 45, wherein the wild card is selected from the group consisting of deuces and jokers.

60. A method of playing a wagering game, comprising:

a player placing a multiple part wager to participate in a live casino card game;

a dealer dealing a group of cards from a source of cards to each player;

each player having an opportunity to withdraw a portion of the multiple part wager;

the dealer providing at least one additional card to each player;

the dealer resolving each hand according to a predetermined set of rules; and wherein the house or a player funds player payoffs.

61. The method of claim 60, wherein the house collects a fee.

62. The method of claim 60, wherein the multiple part wager is a three-part wager, and the group of cards consists of three cards.

63. The method of claim 60, and further comprising an optional side bet.

64. The method of claim 60, wherein the at least one additional card comprises two community cards.

65. The method of claim 60, wherein the wagering game is played with a standard deck of cards with or without jokers, wherein at least one of the cards is designated wild.

66. The method of claim 63, wherein the wagering game is LET IT RIDE BONUS®.

67. A method of playing a game comprising a set of rules, the method comprising:

a player placing a wager comprising at least two bet segments to participate in the game;

providing the player with information useful as a partial indication of a game outcome;

the player optionally withdrawing at least one but not all bet segments from play;

completing play of the game; and providing the player a prize when the player's game outcome is a winning game outcome according to the set of rules.

68. The method of claim 67, wherein the partial indication is selected from the group consisting of game symbols and clues.

69. The method of claim 67, wherein the game is a television game show.

* * * * *

UNITED STATES PATENT AND TRADEMARK OFFICE

CERTIFICATE OF CORRECTION

PATENT NO. : 6,454,266 B1 
DATED : September 24, 2004
INVENTOR(S) : John G. Breeding, Mark L. Yoseloff and Russell B. Dunn It is certified that error appears in the above-identified patent and that said Letters Patent is hereby corrected as shown below:

Title page,
Item [63], Related U.S. Application Data, cancel current paragraph and insert the following:
-- This application is a continuation-in-part of U.S. Patent Application Serial No. 09/317,705, filed May 24, 1999, now U.S. Patent 6,273, 424, which is a continuation-in-part of U.S. Patent Application Serial No. 08/970,966, filed November 14, 1997, now U.S. Patent 6,019,374, which is a continuation of U.S. Application Serial No. 08/695,640, filed August 12, 1996, now abandoned, which is a continuation-in-part of U.S. Patent Application Serial No. 08/388,292, filed February 14, 1995, now U.S. Patent 5,544,892, which is a continuation-in-part of U.S. Patent Application Serial No. 08/043,413, filed April 6, 1993, now U.S. Patent 5,417,430, which is a continuation-in-part of U.S. Patent Application No. 08/023,196, filed February 5, 1993, now U.S. Patent 5,288,081. --

Column 1,
Cancel lines 6-16, and insert the following:
-- This application is a continuation-in-part of U.S. Patent Application Serial No. 09/317,705, filed May 24, 1999, now U.S. Patent 6,273,424, which is a continuation-in-part of U.S. Patent Application Serial No. 08/970,966, filed November 14, 1997, now U.S. Patent 6,019,374, which is a continuation of U.S. Application Serial No. 08/695,640, filed August 12, 1996, now abandoned, which is a continuation-in-part of U.S. Patent Application Serial No. 08/388,292, filed February 14, 1995, now U.S. Patent 5,544,892, which is a continuation-in-part of U.S. Patent Application Serial No. 08/043,413, filed April 6, 1993, now U.S. Patent 5,417,430, which is a continuation-in-part of U.S. Patent Application No. 08/023,196, filed February 5, 1993, now U.S. Patent 5,288,081. --.

Signed and Sealed this

Eighteenth Day of April, 2006

JON W. DUDAS
*Director of the United States Patent and Trademark Office*

UNITED STATES PATENT AND TRADEMARK OFFICE

CERTIFICATE OF CORRECTION

PATENT NO. : 6,454,266 B1
APPLICATION NO. : 09/928645
DATED : September 24, 2002
INVENTOR(S) : John G. Breeding, Mark L. Yoseloff and Russel B. Dunn It is certified that error appears in the above-identified patent and that said Letters Patent is hereby corrected as shown below:

Title page,
Item [63], Related U.S. Application Data, cancel current paragraph and insert the following:
-- This application is a continuation-in-part of U.S. Patent Application Serial No. 09/317,705, filed May 24, 1999, now U.S. Patent 6,273, 424, which is a continuation-in-part of U.S. Patent Application Serial No. 08/970,966, filed November 14, 1997, now U.S. Patent 6,019,374, which is a continuation of U.S. Application Serial No. 08/695,640, filed August 12, 1996, now abandoned, which is a continuation-in-part of U.S. Patent Application Serial No. 08/388,292, filed February 14, 1995, now U.S. Patent 5,544,892, which is a continuation-in-part of U.S. Patent Application Serial No. 08/043,413, filed April 6, 1993, now U.S. Patent 5,417,430, which is a continuation-in-part of U.S. Patent Application No. 08/023,196, filed February 5, 1993, now U.S. Patent 5,288,081. --

Column 1,
Cancel lines 6-16, and insert the following:
-- This application is a continuation-in-part of U.S. Patent Application Serial No. 09/317,705, filed May 24, 1999, now U.S. Patent 6,273,424, which is a continuation-in-part of U.S. Patent Application Serial No. 08/970,966, filed November 14, 1997, now U.S. Patent 6,019,374, which is a continuation of U.S. Application Serial No. 08/695,640, filed August 12, 1996, now abandoned, which is a continuation-in-part of U.S. Patent Application Serial No. 08/388,292, filed February 14, 1995, now U.S.

UNITED STATES PATENT AND TRADEMARK OFFICE

CERTIFICATE OF CORRECTION

PATENT NO. : 6,454,266 B1
APPLICATION NO. : 09/928645
DATED : September 24, 2002
INVENTOR(S) : John G. Breeding, Mark L. Yoseloff and Russel B. Dunn It is certified that error appears in the above-identified patent and that said Letters Patent is hereby corrected as shown below:

Patent 5,544,892, which is a continuation-in-part of U.S. Patent Application Serial No. 08/043,413, filed April 6, 1993, now U.S. Patent 5,417,430, which is a continuation-in-part of U.S. Patent Application No. 08/023,196, filed February 5, 1993, now U.S. Patent 5,288,081. --.

This certificate supersedes Certificate of Correction issued April 18, 2006.

Signed and Sealed this

Eighth Day of August, 2006

JON W. DUDAS
*Director of the United States Patent and Trademark Office*